US005797291A

United States Patent [19]

Yamada

[11] Patent Number: 5,797,291

[45] Date of Patent: Aug. 25, 1998

[54] DIE SET FOR MANUFACTURING HEAT EXCHANGING FIN OF HEAT EXCHANGER

[75] Inventor: Mamoru Yamada, Tokyo, Japan

[73] Assignee: Hidaka Seiki Kabushiki Kaisha, Tokyo, Japan

[21] Appl. No.: 821,579

[22] Filed: Mar. 18, 1997

[30] Foreign Application Priority Data

Apr. 8, 1996 [JP] Japan ..... 8-085020

[51] Int. Cl.[6] ..... B21D 45/06

[52] U.S. Cl. ..... 72/344; 72/334; 72/356

[58] Field of Search ..... 72/334, 344, 348, 72/356, 361, 405.06, 405.07, 463

[56] References Cited

U.S. PATENT DOCUMENTS 4,118,968 10/1978 Ames ..... 72/344

*Primary Examiner*—Lowell A. Larson

*Attorney, Agent, or Firm*—Birch, Stewart, Kolasch & Birch, LLP

[57] ABSTRACT

The die set manufactures a heat exchanging fin by the steps of: forming a projected section in a thin metal plate; drawing the projected section, once or a plurality of times, to reduce the diameter thereof and to form the projected section into a cylindrical section; and piercing and barring the cylindrical section to form into a collar section through which a heat exchanging pipe is pierced. The die set comprises: a lower die; an upper die having a die hole whose diameter is shorter than the bottom diameter of the projected section not drawn; a punch being provided in the lower die; and a lifter being provided in the lower die, the lifter being biased toward the upper die by elastic means, the lifter having a through-hole through which the punch passes and an accommodating space for accommodating a slackened section of the projected section, which is formed in the vicinity of a base thereof while drawing the projected section.

16 Claims, 5 Drawing Sheets

FIG.1
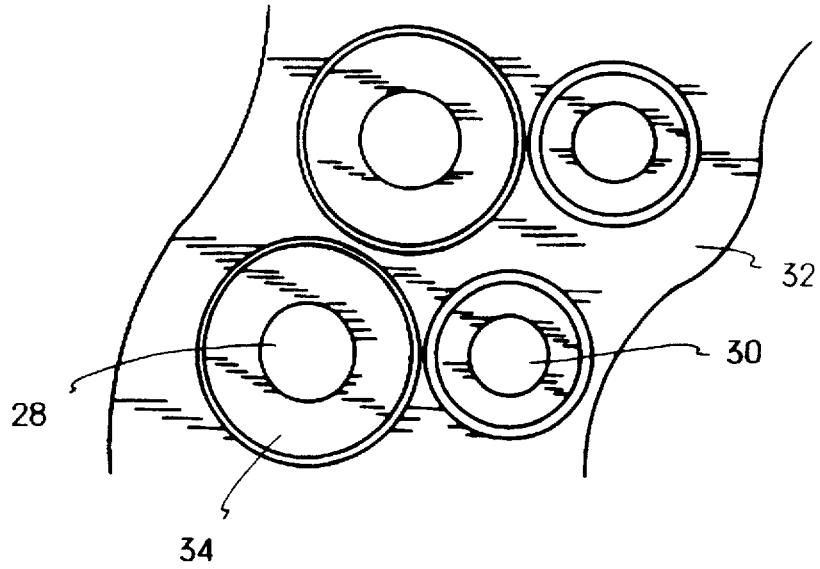
FIG.2
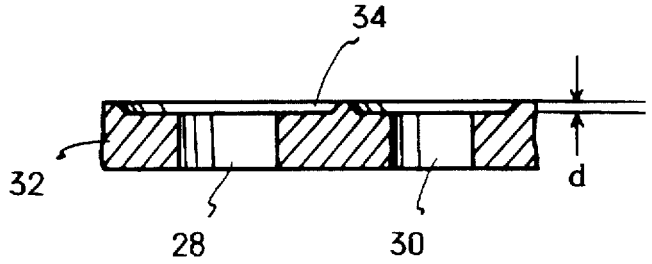
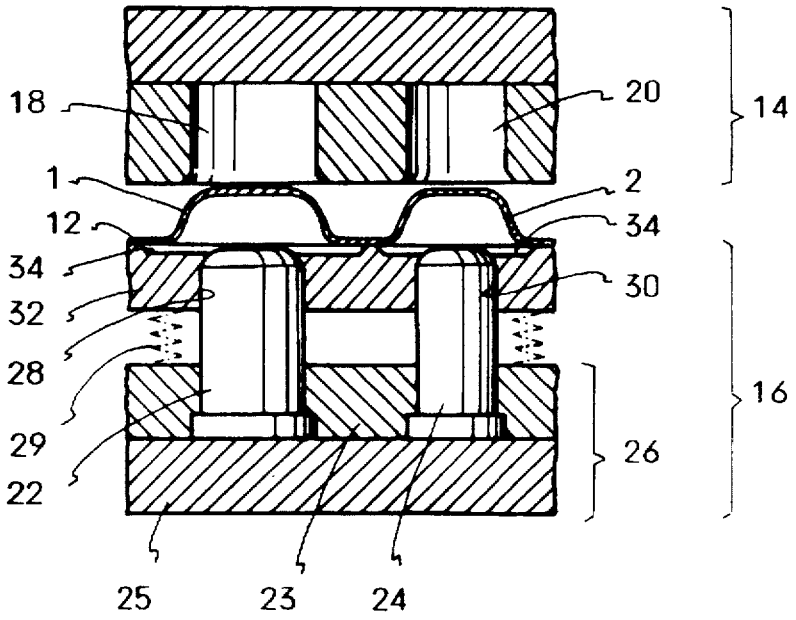
FIG.3

FIG.10A
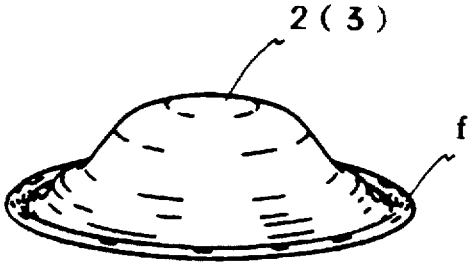
FIG.10B
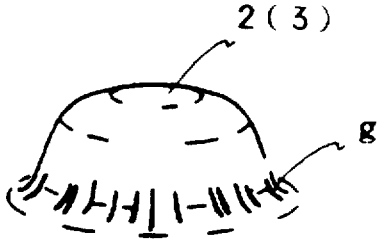
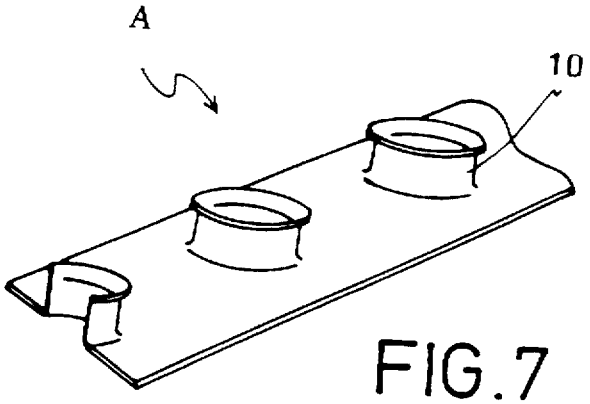
FIG.7
FIG.11
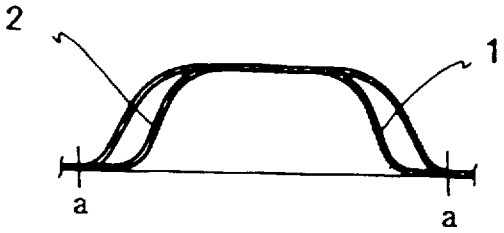
FIG.12
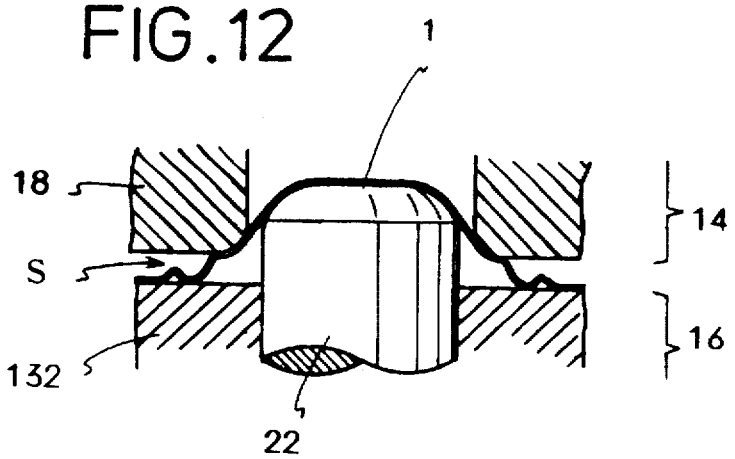

DIE SET FOR MANUFACTURING HEAT EXCHANGING FIN OF HEAT EXCHANGER

BACKGROUND OF THE INVENTION

The present invention relates to a die set for manufacturing a heat exchanging fin of a heat exchanger, more precisely relates to a die set for manufacturing the heat exchanging fin by the steps of: forming a projected section in a thin metal plate; drawing the projected section to reduce the diameter thereof and to form the projected section into a cylindrical section; and piercing and barring the cylindrical section to form into a collar section through which a heat exchanging pipe is pierced.

Heat exchanging fins A (see FIG. 7) are used in heat exchangers of room air conditioners, etc. In the air conditioner, a plurality of the heat exchanging fins A are piled, and the heat exchanging pipe is pierced through collar sections 10.

The heat exchanging fins A are manufactured by a press machining method. The method is shown in FIGS. 8A and 8B. In FIGS. 8A and 8B, the thin metal plate 12, e.g., aluminum, is fed in a direction of an arrow B and onto a pressdie so as to form collar sections 10 by drawing. FIG. 8A is a plan view showing the drawing step; FIG. 8B is a longitudinal sectional view showing the same.

The metal plate 12 is intermittently fed in the direction of the arrow B. Firstly, projected sections 1 are formed; next, the projected sections 1 are drawn (a first drawing step) so as to reduce the inner diameter thereof, so that the projected sections 1 are formed into projected sections 2; further, the projected sections 2 are drawn (a second drawing step) so as to form the projected sections 2 into projected sections 3. The projected sections 3 are further drawn (a third drawing step), whose diameter reduction rate is less than that of the first and the second drawing steps, so as to form the projected sections 3 into projected sections 4. A bottom face of an upper die contacts the metal plate 12, which is mounted on a lower die, so as to flatten the metal plate 12 or form grooves on the metal plate 12.

Successively, the projected sections 4 are pierced and barred, further ironed if required, so as to form the projected sections 4 into cylindrical sections 5. Upper ends of the cylindrical sections 5 are bent to form into the collar sections 10 having flange sections at upper ends thereof.

The metal plate 12 having the collar sections 10 are cut to make a plurality of strips of the heat exchanging fins A.

As shown in FIGS. 8A and 8B, the projected sections 3, which have been drawn as the second drawing step, are further drawn as the third drawing step. The diameter reduction rate of the third drawing step is less than that of the first and the second drawing steps, so they are substantially drawn in the first and the second drawing steps. The first and the second drawing steps can be executed by a die set shown in FIGS. 9A, 9B and 9C. In FIGS. 9A, 9B and 9C, an upper die 14 is capable of vertically moving close to and away from a lower die 16. The upper die 14 has: die holes 18 for drawing the projected section 1, and the inner diameter of the die holes 18 is shorter than the bottom diameter of the projected sections 1 which are not drawn; and die holes 20 for drawing the projected section 2, and the inner diameter of the die holes 20 is shorter than the bottom diameter of the projected sections 2. The die hole 18 and the die hole 20 are arranged in the feeding direction of the metal plate 12.

The lower die 16 has: a lower base 26 including a punch holder 23 for vertically holding punches 22 and 24; and a lifter 132, which is always biased toward the upper die 14 by a biasing means (not shown), e.g., a spring, and which has through-holes 28 and 30 through which upper end sections of the punches 22 and 24, which are capable of entering the die holes 18 and 20, pass when the lifter 132 is pushed toward the lower base 26 by the upper die 14.

In the die set shown in FIGS. 9A, 9B and 9C, the metal plate 12 is mounted on the lifter 132 of the lower die 16 as shown in FIG. 9A. Then the upper die 14 is moved downward as shown in FIG. 9B, and the lifter 132 is pushed toward the lower base 26 by pins (not shown) of the upper die 14. With this action, the upper end sections of the punches 22 and 24, which have been vertically held in the lower base 26, pass the through-holes 28 and 30 and enter the projected sections 1 and 2.

When the upper die 14 is further moved downward until the upper die 14 contacts the lower die 16 as shown in FIG. 9C, the upper end sections of the punches 22 and 24 enter the die holes 18 and 20, so that the projected sections 1 and 2 are drawn between the upper end sections of the punches 22 and 24 and inner faces of the die holes 18 and 20.

Next, the upper die 14 is moved upward, and the metal plate 12 is moved upward until reaching the feeding level by the lifter 132. Then the metal plate 12 is sent to machine the drawn projected sections for the next machining step.

By the die set shown in FIGS. 9A, 9B and 9C, the heat exchanging fin A having the high collar sections 10 can be manufactured.

However, there are formed ring-like deformed sections f (see FIG. 10(*a*)) and crease-like deformed sections g (see FIG. 10(*b*)) in the vicinity of bases of the projected sections 2 and 3 of the metal plate 12, which has been machined by the die set shown in FIGS. 9A, 9B and 9C. The deformed sections f and g are hardened by machining, so it is difficult to smoothly machine said sections in the next machining steps. With the deformed sections f and g, the collar sections 10 cannot have enough height and good external appearance.

These days the thinner metal plate 12 is required. So the thinner metal plate 12 has been machined to form the collar sections by drawing. By employing the thinner metal plate, the ring-like and the crease-like deformed sections f and g are apt to be formed in the vicinity of the projected sections in the metal plate 12.

SUMMARY OF THE INVENTION

An object of the present invention is to provide a die set for manufacturing heat exchanging fins, which is capable of preventing the metal plate from forming the ring-like and the crease-like deformed sections in the vicinity of the projected sections so as to smoothly make the collar sections having enough height and good external appearance.

To achieve the object, the inventor studied a cause of forming the ring-like deformed sections f and the crease-like deformed sections g shown in FIGS. 10A and 10B.

To compare the size of the projected section 1 not drawn and the drawn projected sections 2, sectional views of both projected sections 1 and 2 are overlapped as shown in FIG. 11. The surface area of the "a—a" part of the projected section 1 is about 7% greater than surface area of the "a—a" part of the projected section 2.

By the above described result, the 7% surface area of the projected section 1, which has been removed therefrom, is changed to a slackened section S shown in FIG. 12, which is formed in the vicinity of the projected section 1 when the projected section 1 is drawn. If the slackened section S, which is in a slackened state, is pressed between the upper die 14 and the lifter 132 of the lower die 16, the metal plate in the vicinity of the base of the projected section is deformed into the ring-like deformed section f and the crease-like deformed section g. Further, the ring-like deformed section f and the crease-like deformed section g are hardened by buckling of the metal plate, so that machining in the following steps will be difficult in said sections.

The inventor further studied on the basis of the results, and he has found that the slackened section S is formed in the vicinity of the base of the projected section when the upper die 14 contacts the lifter 132 of the lower die 16 for drawing, and an accommodating section of the lifter 132, which is capable of accommodating the slackened section S, can avoid pressing the slackened section S by the upper die 14 and the lower die 16, so that forming the deformed sections f and g can be prevented.

To achieve the object, in the present invention, the die set for manufacturing a heat exchanging fin of a heat exchanger by the steps of: forming a projected section in a thin metal plate; drawing the projected section, once or a plurality of times, to reduce the diameter thereof and to form the projected section into a cylindrical section; and piercing and barring the cylindrical section to form into a collar section through which a heat exchanging pipe is pierced, comprising:

a lower die;

an upper die being capable of moving close to and away from the lower die, the upper die having a die hole for drawing the projected section wherein the diameter of the die hole is shorter than the bottom diameter of the projected section which is not drawn;

a punch being vertically provided in a base of the lower die, an upper end section of the punch being capable of entering the die hole; and a lifter being provided in the lower die, the lifter being biased toward the upper die by elastic means, the lifter having a through-hole through which the upper end section of the punch passes when the lifter is moved toward the base of the lower die by the upper die, the lifter having an accommodating space, which faces the die hole and which is capable of accommodating a slackened section of the projected section, which is formed in the vicinity of a base thereof while drawing the projected section.

The die set may comprise:

an upper die being capable of moving close to and away from the lower die, the upper die having a plurality of die holes for drawing the projected section wherein the die holes are linearly arranged in a feeding direction of the metal plate, the inner diameter of the die holes being shorter than the bottom diameter of the projected section, which is not drawn, and made shorter in the feeding direction;

a plurality of punches being vertically provided in a base of the lower die, upper end sections of the punches being capable of entering each die hole; and a lifter being provided in the lower die, the lifter being biased toward the upper die by elastic means, the lifter having through-holes through each of which each upper end section of each punch passes when the lifter is moved toward the base of the lower die by the upper die, the lifter having an accommodating space, which faces at least the die hole for a first drawing step and which is capable of accommodating a slackened section of the projected section, which is formed in the vicinity of a base thereof while drawing the projected section. With this structure, the drawing can be executed a plurality of times, gradually, for the projected section. By drawing a plurality of times, the height of the collar section can be higher than that of the collar section which is formed by drawing the metal plate, which has the same thickness, once.

In the die set, a plurality of concave sections may be formed in the lifter as the accommodating spaces, wherein an end of each through-hole is opened in an inner bottom face of each concave section, and diameter of the concave section is greater than the bottom diameter of the projected section which is not drawn. With this structure, the accommodating sections can be formed easily. In this case, the concave section and the through-hole, whose end is opened in the inner bottom face of the concave section, in each combination may be coaxially arranged. With this structure, the accommodating sections can be more easily formed.

In the die set, a concave section may be formed in the lifter as the accommodating space, an end of each through-hole is opened in an inner bottom face of the concave section. In this case, the concave section or the accommodating section can be formed easier than the case of forming the accommodating section independently.

In the die set, the diameter of the through-hole may be greater than that of the upper end section of the punch, which enters the die hole, so as to form the accommodating space in the through-hole of the lifter when the upper end section enters the through-hole. With this structure, the through-hole acts as the accommodating space and a guide way of the punch, so no concave section is required.

In the die set, a plurality of concave sections may be formed in the lifter as the accommodating spaces, wherein an end of each through-hole is opened in an inner bottom face of each concave section; and the diameter of the concave section is greater than the bottom diameter of the projected section which is not drawn, and another type of concave section may be formed in the lifter as the accommodating space, wherein ends of some through-holes are opened in an inner bottom face of the other type of concave section.

By employing the die set of the present invention, the collar sections of the heat exchanging fins can have enough height and good external appearance. In the conventional die set which manufactures the heat exchanging fins by drawing, slackened sections are formed in the vicinity of the projected sections while drawing. But, in the die set of the present invention, the lifter has the accommodating space so the slackened section is accommodated in the accommodating space when the upper die contacts the lower die. Thus, pressing the slackened section by the upper die and the lifter of the lower die can be prevented. With this structure, the slackened section, which has been accommodated in the accommodating space, is not hardened, so the slackened section can be easily extended when the upper end section of the punch enters the die hole for drawing the projected section. With this structure, substantially no deformed sections are formed in the vicinity of the projected sections in the metal plate, so that the projected section can be effectively drawn. The following machining steps can be executed, and the projected sections or the collar sections having good external appearance can be formed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be described by way of examples and with reference to the accompanying drawings which are given by way of illustration only, and thus are not limitative of the present invention, and, in which:

FIG. 1 is a partial front view of a lifter of the die set of an embodiment of the present invention;

FIG. 2 is a partial sectional view of the lifter shown in FIG. 1;

FIG. 3 is a partial sectional view of the die set having the lifter shown in FIGS. 1 and 2;

FIG. 7 is a partial perspective view of the heat exchanging fin;

FIGS. 10A and 10B are explanation views showing the deformed sections, which have been formed in the vicinity of the projected sections in the metal plate after drawing;

FIG. 11 is an explanation view showing the difference of the diameter reduction rate between the projected section not drawn and the projected section drawn; and FIG. 12 is an explanation view showing the details of drawing the projected section.

DETAILED DESCRIPTION OF THE PREFERRED EMBODIMENTS

Figure 4A:
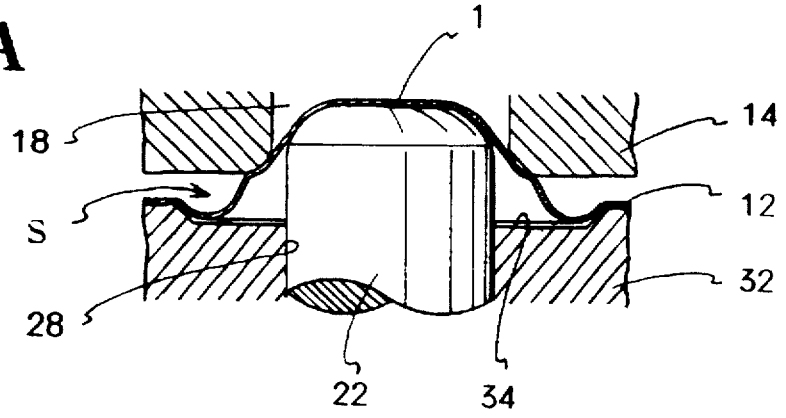
FIGS. 4A and 4B are explanation views showing the action of the die set shown in FIG. 3.

Preferred embodiments of the present invention will now be described in detail with reference to the accompanying drawings.

In a die set of an embodiment of the present invention, as shown in FIG. 1, concave sections 34 are formed in an upper face of a lifter 32. The concave sections 34 respectively include each upper end of through-hole 28 and 30, through which an upper end section of each punch passes while drawing projected sections in a thin metal plate. The concave sections 34 are capable of accommodating slackened sections of the metal plate, which are formed in the vicinity of the projected sections when the projected sections are drawn, as accommodating spaces.

The circular concave section 34 and the circular through-hole 28 or 30 in each combination are coaxially formed as shown in FIG. 2. The depth d of the concave section 34 is 1–2 mm. The diameter of the concave section 34 is greater than that of the projected section, which is not drawn to reduce the diameter.

The die set having the lifter 32 shown in FIGS. 1 and 2 is shown in FIG. 3. In the die set shown in FIG. 3, an upper die 14 is capable of vertically moving close to and away from a lower die 16. The upper die 14 has: die holes 18 for drawing whose inner diameter is less than the bottom diameter of the projected sections 1, which are not drawn, in the metal plate 12 and the inner diameter of die holes (not shown) for forming the projected sections 1; and die holes 20 for drawing whose inner diameter is less than the bottom diameter of projected sections 2, which are formed by drawing the projected sections 1 in the die holes 18, and the inner diameter of the die holes 18. The die hole 18 and the die hole 20 are arranged in a feeding direction of the metal plate 12.

The lower die 16 has: a lower base 26 including a punch holder 23 for vertically holding punches 22 and 24 and a lower member 25; and a lifter 32, which is always biased toward the upper die 14 by a biasing means, e.g., springs 29, and which has through-holes 28 and 30 through which upper end sections of the punches 22 and 24, which are capable of entering the die holes 18 and 20, pass when the lifter 32 is pushed toward the lower base 26 by the upper die 14.

The lifter 32 has the concave sections 34, which respectively face the die holes 18 for a first drawing step and the die holes 20 for the second drawing step. The upper end of each through-hole 28 and 30 is opened in an inner bottom face of the each concave section 34.

Figure 4B:
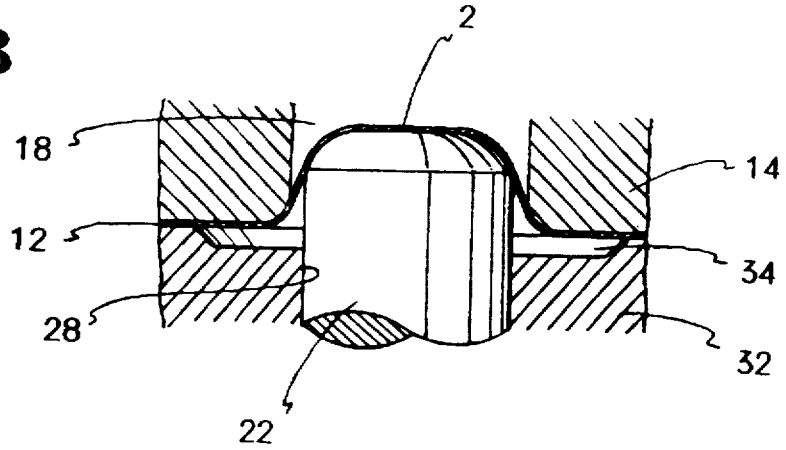

Drawing steps with the die set shown in FIG. 3 is shown in FIGS. 4A and 4B. Firstly, the upper die 14 is moved downward as shown in FIG. 4A, and the lifter 32 is pushed toward the lower base 26 against the elasticity of the springs 29 by pins (not shown) of the upper die 14. With this action, the upper end sections of the punch 22 passes the through-hole 28 and enters the die hole 18, so that the base section of the projected section 1 contacts an inner edge of the die hole 18.

While the base section of the projected section 1 contacts the inner edge of the die hole 18, the upper die 14 is further moved downward, so that the lifter 32 and the upper die 14 pinch the metal plate 12 as shown in FIG. 4B.

In this state, the base section of the projected section 1, which contacts the inner edge of the die hole 18, is formed into a slackened section S. The slackened section S is accommodated in the concave section 34 or the accommodating space, so pinching and pressing of the slackened section S between the lifter 32 and the upper die 14 can be avoided. With this structure, hardening the slackened section S can be prevented. Since the slackened section S is not hardened by the press, the projected section 1 can be effectively drawn and easily machined in the following steps.

A part of the metal plate 12, which is located in the vicinity of the concave section 34, is pinched by the lifter 32 and the upper die 14, and the slackened section S is extended by the upper end section of the punch 22, which contacts the projected section 1, so that the projected section 2 having good external appearance can be formed.

Note that, drawing the projected section 1 has been explained with reference to FIGS. 4A and 4B. Drawing the projected section 2 will be drawn as well as the projected section 1.

In the die set shown in FIG. 3, the concave sections 34 are formed in the lifter 32 to respectively correspond to the die holes 18 and 20 for forming the projected sections 2 and 3 by drawing; no concave sections 34 are formed in the lifter 32 to respectively correspond to the die holes for forming the projected section 4. The projected sections 4 is formed by drawing the projected section 3, which has been formed by drawing the projected section 2, with the diameter reduction rate less than the rate of the first drawing step for forming the projected section 1 and the second drawing steps for forming the projected sections 2. The lower diameter reduction rate is employed so as to avoid forming the slackened sections S and to flatten parts of the metal plate 12, which are around the projected sections 3, and form grooves thereon by pressing a bottom face of the upper die 14 onto the metal plate 12.

The concave sections 34 may be formed at positions in the lifter 32, which correspond to the die holes 18 for forming the projected sections 2 by drawing. The reason is that the diameter reduction rate for the first drawing step, which is applied to the projected sections 1, is greater than that of the second drawing step, which is applied to the projected sections 2.

Figure 5A:
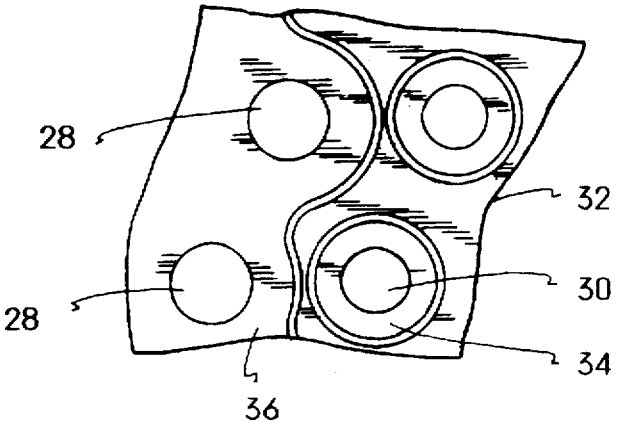
FIGS. 5A and 5B are explanation views showing another example of the lifter.
Figure 5B:
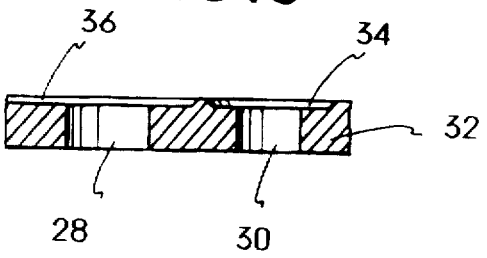

In the die set of the present invention, the accommodating space is formed between the upper die 14 and the lifter 32 when the upper die 14 contacts the lifter 32, so the upper ends of a plurality of through-holes 28 may be opened in an inner bottom face of a broad concave section 36 as the accommodating space (see FIGS. 5A and 5B). By employing the concave section 36, the concave section 36 can be made easier than the concave sections 34.

Note that, the concave sections 36, in each of which a plurality of the through-holes 28 are opened, and the concave sections 34, in each of which one through-hole 30 is opened, may exist in the upper face of the lifter 32.

Figure 6A:
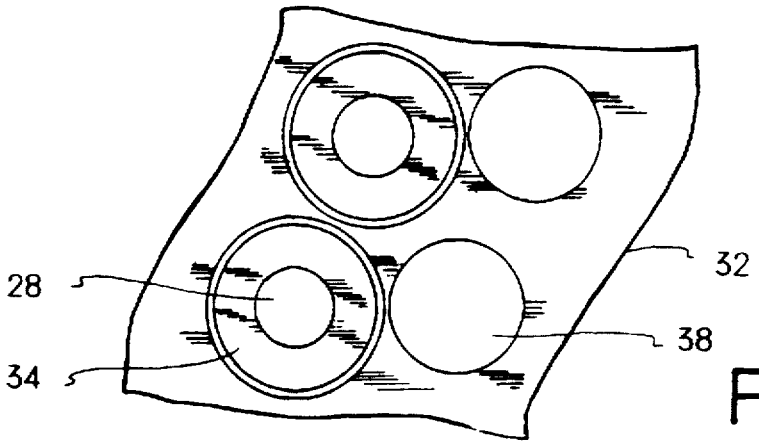
FIGS. 6A and 6B are explanation views showing another example of the lifter.
Figure 6B:
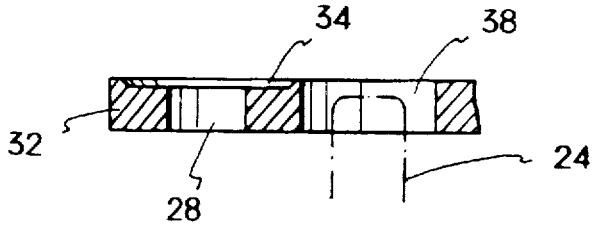
Figure 8A:
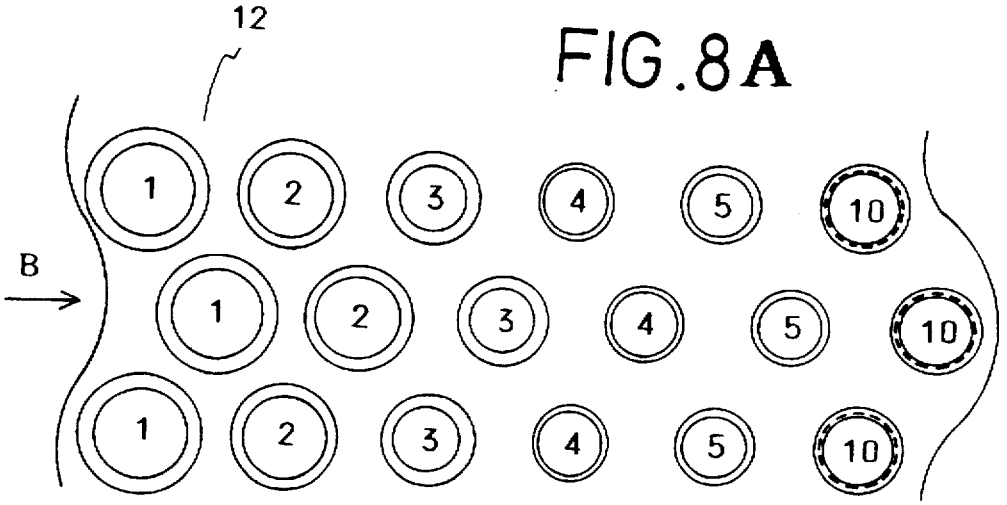
FIGS. 8A and 8B are explanation views showing the drawing steps for forming the heat exchanging fins.
Figure 8B:
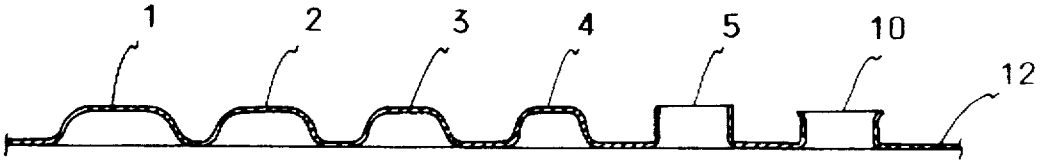
Figure 9A:
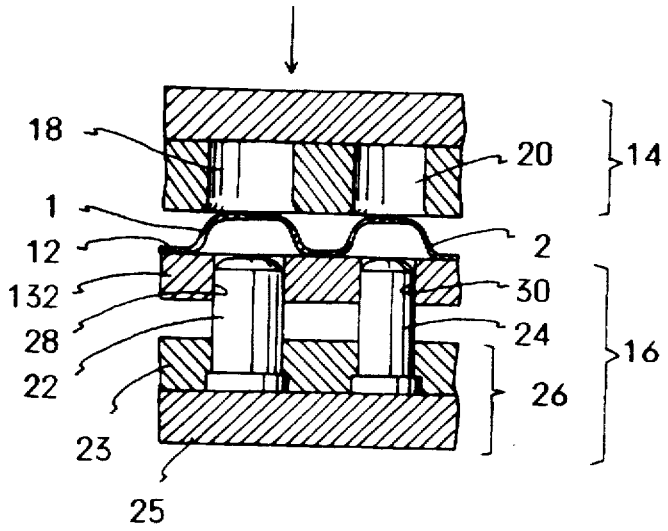
FIG.9A PRIOR ART
FIGS. 9A, 9B and 9C are explanation views showing the action of the conventional die set.
Figure 9B:
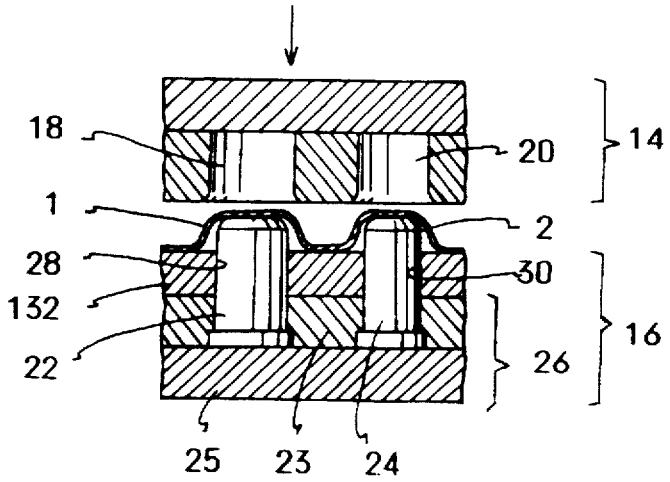
FIG.9B PRIOR ART
Figure 9C:
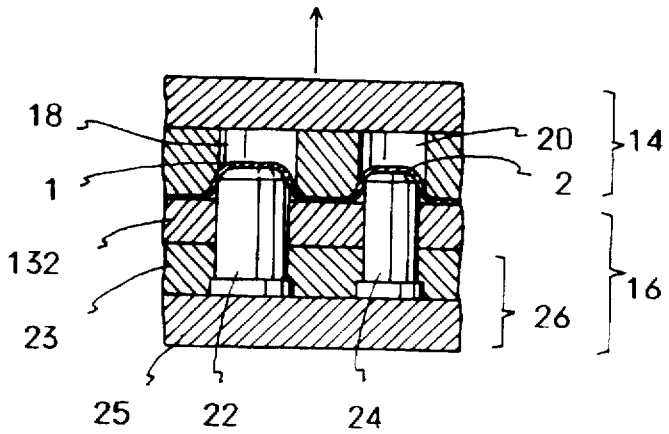
FIG.9C PRIOR ART

In FIGS. 6A and 6B, the through-holes 38 whose inner diameter is greater than the diameter of the upper end sections of the punches 24, which enter the die holes 20, may be bored in the lifter 32. By the through-holes 38, there is formed the accommodating space for accommodating the slackened section, which is formed in the vicinity of the base of the projected section of the metal plate, between the side face of the upper end section of the punch 24 and the inner face of the through-hole 38 when the upper end section of the punch 24 enters the through-hole 38 (see FIG. 6B). The through-holes 38 act as the through-holes for guiding the upper end section of the punch 24 and the accommodating spaces, so no concave sections 34 are required in the lifter 34.

To form the accommodating spaces between the upper die 14 and the lifter 34 when the upper die 14 contacts the lifter 34, the lifter 34 may have the concave sections 34 and 36 and the through-holes 38.

In the die sets shown in FIGS. 1–6B, the projected sections 1 of the metal plate 12 are drawn a plurality of times. In the case of forming the collar sections 10, which have a greater diameter and lower height, the projected section may be drawn once. In this case, the concave sections 34 or 36 or the through-holes 38, which respectively face each die hole 18, are formed in the lifter 32 as the accommodating spaces for accommodating the slackened sections formed in the vicinity of the projected sections 1 of the metal plate 12.

In the present invention, forming the ring-like and crease-like deformed sections, which are formed in the vicinity of the projected sections of the metal plate when the projected sections are drawn to make the heat exchanging fins, can be prevented, so that the collar sections having enough height and good external appearance can be made easily. Thus, the heat exchanging fins having the collar sections, which have enough height and good external appearance, can be easily made of thinner metal plates by drawing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A die set for manufacturing a heat exchanging fin of a heat exchanger by the steps of: forming a projected section in a thin metal plate; drawing the projected section to reduce a diameter thereof and to form the projected section into a cylindrical section; and piercing and barring the cylindrical section to form into a collar section through which a heat exchanging pipe is pierced, comprising:

a lower die;

an upper die movable close to and away from said lower die, said upper die having a die hole for drawing the projected section wherein a diameter of the die hole is less than a bottom diameter of the projected section which is not drawn;

a punch vertically provided in a base of said lower die, an upper end section of said punch for entering the die hole; and a lifter provided in said lower die, said lifter being biased toward said upper die by elastic means, said lifter having a through-hole which the upper end section of said punch passes when said lifter is moved toward the base of said lower die by said upper die, said lifter having an accommodating space, which faces the die hole and which accommodates a slackened section of the projected section, which is formed in the vicinity of a base of the projected section while drawing the projected section.

2. The die set according to claim 1, wherein said upper die has a plurality of said die holes, said lower die having a plurality of said punches, the upper end section of each punch for passing through each through-hole and entering the die hole, and wherein a plurality of concave sections are formed in said lifter as said accommodating spaces, an end of each through-hole opening in an inner bottom face of each concave section, a diameter of the concave section being greater than the bottom diameter of the projected section which is not drawn.

3. The die set according to claim 2, wherein each concave section and each through-hole in each combination are coaxially arranged.

4. The die set according to claim 1, wherein said upper die has a plurality of said die holes, said lower die having a plurality of said punches, the upper end section of each punch for passing through each through-hole and entering the die hole, and wherein a concave section is formed in said lifter as said accommodating space, an end of each through-hole opening in an inner bottom face of the concave section.

5. The die set according to claim 1, wherein said upper die has a plurality of said die holes, said lower die having a plurality of said punches, the upper end section of each punch for passing through each through-hole and entering the die hole, wherein a plurality of first concave sections are formed in said lifter as first accommodating spaces, an end of some of said through-holes opening in an inner bottom face of said first concave sections, a diameter of said first concave sections being greater than the bottom diameter of the projected section which is not drawn, and wherein the die set further comprises a plurality of second concave sections formed in said lifter as second accommodating spaces, ends of some of said through-holes opening in an inner bottom face of said second concave sections.

6. The die set according to claim 1, wherein a diameter of the through-hole is greater than that of the upper end section of the punch, which enters the die hole, so as to form an accommodating section in the through-hole of said lifter when the upper end section enters the die hole.

7. A die set for manufacturing a heat exchanging fin of a heat exchanger by the steps of: forming a projected section in a thin metal plate; drawing the projected section to reduce a diameter thereof and to form the projected section into a cylindrical section; and piercing and barring the cylindrical section to form into a collar section through which a heat exchanging pipe is pierced, comprising:

a lower die;

an upper die being moveable close to and away from said lower die, said upper die having a plurality of die holes for drawing the projected section wherein the die holes are linearly arranged in a feeding direction of the metal plate, an inner diameter of the die holes being less than a bottom diameter of the projected section, which is not drawn;

a plurality of punches being vertically provided in a base of said lower die, upper end sections of said punches being capable of entering each of said plurality of die holes, and a lifter being provided in said lower die, said lifter being biased toward said upper die by elastic means, said lifter having through-holes through each of which each upper end section of each punch passes when said lifter is moved toward the base of said lower die by said upper die, said lifter having an accommodating space, which faces at least the die hole for a first drawing step and which accommodates a slackened section of the projected section, which is formed in the vicinity of a base of the projected section while drawing the projected section.

8. The die set according to claim 7, wherein a plurality of concave sections are formed in said lifter as said accommodating spaces, an end of each through-hole opening in an inner bottom face of each concave section, a diameter of the concave section being greater than the bottom diameter of the projected section which is not drawn.

9. The die set according to claim 8, wherein each concave section and each through-hole in each combination are coaxially arranged.

10. The die set according to claim 7, wherein a concave section is formed in said lifter as said accommodating space, an end of each through-hole opening in an inner bottom face of the concave section.

11. The die set according to claim 7, wherein a plurality of first concave sections are formed in said lifter as first accommodating spaces, an end of some of said through-holes opening in an inner bottom face of each said first concave section, a diameter of said first concave section being greater than the bottom diameter of the projected section which is not drawn, and wherein the die set further comprises a plurality of second concave sections formed in said lifter as second accommodating spaces, ends of some through-holes opening in an inner bottom face of said second concave sections.

12. The die set according to claim 7, wherein a diameter of each through-hole is greater than that of the upper end section of each punch, which enters the die hole, so as to form an accommodating section in each through-hole of said lifter when the upper end section enters the die hole.

13. The die set according to claim 12, wherein the accommodating sections are linearly arranged in a feeding direction of the metal plate, the inner diameter of the die holes being made less in the feeding direction.

14. The die set according to claim 13, wherein a plurality of concave sections are formed in said lifter as said accommodating spaces, an end of each through-hole opening in an inner bottom face of each concave section, a diameter of the concave section being greater than the bottom diameter of the projected section which is not drawn.

15. The die set according to claim 13, wherein each concave section and each through-hole in each combination are coaxially arranged.

16. The die set according to claim 13, wherein a concave section is formed in said lifter as said accommodating space, ends of the through-holes opening in an inner bottom face of said concave section.

* * * * *